US006880263B2

(12) United States Patent
Gasparini et al.

(10) Patent No.: US 6,880,263 B2
(45) Date of Patent: Apr. 19, 2005

(54) FLUID/SOLID INTERACTION APPARATUS

(75) Inventors: Giacomo Salvatore Gasparini, Kew East (AU); Giovanni Barbieri, Kew East (AU)

(73) Assignee: Jott Australia Pty Ltd., Victoria (AU)

( * ) Notice: Subject to any disclaimer, the term of this patent is extended or adjusted under 35 U.S.C. 154(b) by 0 days.

(21) Appl. No.: 10/482,100

(22) PCT Filed: Jun. 25, 2002

(86) PCT No.: PCT/AU02/00824

§ 371 (c)(1),
(2), (4) Date: Dec. 24, 2003

(87) PCT Pub. No.: WO03/001131

PCT Pub. Date: Jan. 3, 2003

(65) Prior Publication Data

US 2004/0194337 A1 Oct. 7, 2004

(30) Foreign Application Priority Data

Jun. 25, 2001 (AU) ..... PR 5901

(51) Int. Cl.[7] ..... F26B 3/06
(52) U.S. Cl. ..... 34/171
(58) Field of Search ..... 34/359, 171, 174, 34/175; 422/143, 195

(56) References Cited

U.S. PATENT DOCUMENTS

| | | | | |
|---|---|---|---|---|
| 2,684,124 A | * | 7/1954 | Hines, Jr. | 95/112 |
| 3,360,867 A | * | 1/1968 | Sanderson | 34/362 |
| 4,119,139 A | * | 10/1978 | Klaren | 165/104.16 |
| 4,188,184 A | | 2/1980 | Fornoni | |
| 4,259,094 A | * | 3/1981 | Nagai et al. | 96/123 |
| 4,349,367 A | | 9/1982 | Krumwiede | |
| 4,474,138 A | | 10/1984 | Remmers et al. | |
| 5,238,659 A | | 8/1993 | Tajiri et al. | |
| 5,406,718 A | * | 4/1995 | Stein | 34/362 |
| 5,876,679 A | * | 3/1999 | D'Acierno et al. | 422/143 |

FOREIGN PATENT DOCUMENTS

| | | |
|---|---|---|
| AU | B-40020/85 | 9/1985 |
| AU | B-12336/92 | 9/1992 |
| AU | B-12347/92 | 9/1992 |
| DE | 20010671 U | 9/2000 |

OTHER PUBLICATIONS

English language abstract for DE19606917 A1, Aug. 28, 1997.
English language abstract for DE3041627 A, Jun. 9, 1982.

(Continued)

*Primary Examiner*—Stephen Gravini
(74) *Attorney, Agent, or Firm*—Birch, Stewart, Kolasch, & Birch, LLP

(57) ABSTRACT

Apparatus (1) is provided for passing a fluid through a solid material (5). Apparatus (1) has an enclosure (2) with an upper part (7) in which the solid material is received. The solid material flows downward through one or more passages (13) which extend between end walls (11 and 12). Opposing sides of the or each passage are formed by side plates (14, 15) of fluid inlet and outled ducts (9, 10). The side plates are perforated so that fluid can pass transversely through the solid material flowing through each passage. The inlet and outlet ducts (9 and 10) have inlet parts (16 and 17) respectively, outside the enclosure. Solid material arrives at a lower part (8) of the enclosure and then leaves the enclosure. The apparatus (1) can be made compactly for the degree of fluid/solid contact provided. It is applicable to many applications such as drying of solids, heat exchange between fluids and solids, dust removal from gases, chemical reactors and humidifying/dehumidifying of fluids. A particular application for which apparatus (1) is suited is the reduction of moisture content of brown coal being used as fuel in electric power generation.

11 Claims, 5 Drawing Sheets

OTHER PUBLICATIONS

English language abstract for DD281237 A, Aug. 1, 1990.
English language abstract for DD143103 A, Jul. 30, 1980.
English language abstract for DE4003499, Aug. 9, 1990.
English language abstract for DE4314010 A1, Oct. 27, 1994.
English language abstract for DE4124842 A1, Jan. 28, 1993.
English language abstract for DE4305543 A1, Aug. 25, 1994.
English language abstract for DE3041627 A, Jun. 9, 1982.

* cited by examiner

FLUID/SOLID INTERACTION APPARATUS

FIELD OF THE INVENTION

This invention concerns a device and a method for bringing together solid-phase and fluid phase materials in such a manner that the fluid phase material flows through or into the solid phase material.

BACKGROUND

There are many processes in which it is desired to bring together firstly a solid phase material and secondly a fluid phase material in such a manner that the fluid phase material flows through, past or into, the solid phase material. Some of these are mentioned below. However, it is to be emphasized that the apparatus and method disclosed herein are believed potentially applicable to a broader range of materials and applications than the specific examples given.

A process of great practical importance is drying. For example, solid fuels used in combustion processes, such as brown and black coal, have often to be dried before combustion, and it is known to pass through beds of such materials combustor flue gases or gases indirectly heated by the combustion process.

Another essentially physical process class in which it may be desired to pass a fluid through a solid-phase material is heat exchange between a solid phase material and either a liquid or gas. As an example of a case where the fluid is a gas, U.S. Pat. No. 4,349,367 describes a method of recovering waste heat from furnace flue gases using a granular heat exchange means. This method involves passing gases from a furnace exhaust through a first bed of granular heat exchange medium so as to heat the medium. The heated medium is then passed to a second heat exchange bed where air being supplied to the furnace for combustion is passed through the (heated) medium to preheat the air. In this manner a portion of the waste heat is returned to the furnace by way of incoming combustion air. The apparatus used in this method comprises a cylindrical vessel having an annular cavity through which the granular heat exchange medium passes. The sides of the annular cavity are defined by concentrically arranged sets of louvres which facilitate passage of the furnace exhaust gases radially through the heat exchange medium. This system requires the use of a granular medium which is chemically inert and resists attrition; gravel, stone aggregates, ceramics or other refractory materials are preferred. The cylindrical configuration is not necessarily ideal for all combinations of solid- and gas-phase throughput volumes.

A still further fluid/solid process of importance, and to which the invention described below has potential application, is dust removal from gases. One of the many classes of device for this process is the so-called "cleanable granular bed filter", wherein gas-laden dust is passed through a particle-removing granular medium that may be circulated continuously or emptied periodically from the dust removal unit. More generally, the invention described below is believed to have potential applications in separation processes where a fluid—be it liquid-phase or gas-phase—is passed through a solid-phase material.

Gas/solid operations also include humidifying and dehumidifying, and the invention herein described may find application in such operations also.

Finally, there are very many processes in which it is desired to pass a fluid through a solid-phase material in order to promote a chemical reaction. The invention described below is also potentially applicable as a reactor for some classes of fluid/solid reactions. The solid phase material could be a reactant or could be a catalyst that requires at intervals to be removed from a reactor vessel and replaced, and the invention can apply to both cases.

It is desirable in all of the application areas mentioned above for compact equipment whose basic design can be readily adapted to provide for particular combinations of fluid and solid material throughput. Furthermore, there is a need in at least some of these application areas for equipment whose design is comparatively easy to adapt for satisfactory flow of the solid phase material passing therethrough.

SUMMARY OF THE INVENTION

In all that follows herein, the term "solid material" is to be interpreted broadly, except where more specific terms are used or made apparent by context. Thus, for example, a solid material may be a granular solid such as wheat or coal or pelletized minerals for example, or (in drying or degassing applications for example) a solid material with some fluid therein, or a mixture of such solid materials. A solid material may even be a paste or gel, or other material with at least partially solid-phase characteristics. The solid material must be one into or through which or onto a surface of which a fluid can be passed, and must be one which can be moved (by flowing or otherwise) through the apparatus disclosed.

Also, for example, "fluid" and "fluid material" are terms to be interpreted broadly. The fluid material in question may be a gas or liquid or a mixture of each or a mixture of gases or a mixture of liquids.

According to the invention there is provided an apparatus for passing a fluid through a solid material including:

an enclosure having an upper part adapted for the receipt of a solid material and a lower part adapted to receive said solid material from said upper part; and a plurality of passages extending between a pair of end walls of said enclosure and connecting said upper and lower parts, wherein sides of said passages are defined by side walls of a plurality of inlet fluid ducts and outlet fluid ducts extending between said end walls, said side walls having first openings into said passages whereby internal spaces of said ducts are in fluid communication with said passages, wherein each said inlet or outlet duct has respectively an inlet or outlet port for said fluid external to said enclosure, wherein each said passage has on its opposing sides an inlet fluid duct and an outlet fluid duct so that in use of the apparatus fluid flows substantially transversely from an inlet duct to an outlet duct through said solid material in each said passage, and wherein the or each said fluid duct that lies between adjacent said passages has a second opening in at least one of said enclosure end walls for fluid communication between said internal space of said fluid duct and said inlet or outlet port of said fluid duct.

As will become apparent below, apparatus of this type can be particularly compact, and provide good crossflow of a fluid through a solid material in the passages. The solid material may flow (or be moved) continuously or intermittently through the apparatus, for example under the action of gravity.

Having the inlet or outlet ports of each duct that lies between adjacent passages allows for a compact design. It may in some applications be particularly desirable to have the inlet ports on one of the end walls and the outlet openings on the other end wall, and the invention permits such an arrangement.

Preferably, at least one of said inlet or outlet fluid ducts decreases in width with increasing distance from the or a said port thereof. This allows for flow of fluid to be kept even across the whole distance between the end walls.

In many if not the majority of applications, at least one of said fluid ducts may have a closed end remote from its said port at or adjacent to the said end wall remote from its said port. This can apply, for example, where it is desirable that all of the fluid flowing into an inlet duct, is to pass through the solid material being treated.

Preferably, each said passage increases in width from top to bottom thereof. This is to provide the best possible freedom of flow of the solid material under gravity downwards through the passages. Further, the degree of taper can be selected at the design stage after no more than routine trialling to give best results in any particular application. This may apply, for example, where the solid material is subject to swelling as the fluid passes through it.

Preferably, where all parts of the solid material are to be exposed equally to the fluid, each said passage is of substantially constant width between said enclosure end walls.

In a further aspect, the invention provides an apparatus for passing a fluid through a solid material including:

an enclosure having an upper part adapted for the receipt of a solid material and a lower part adapted to receive said solid material from said upper part; and a passage extending between a pair of end walls of said enclosure and connecting said upper and lower parts, wherein opposing sides of said passage are defined by side walls of an inlet fluid duct and an outlet fluid duct extending between said end walls, said side walls having first openings into said passage whereby internal spaces of said ducts are in fluid communication with said passage, wherein said inlet and outlet ducts have respectively an inlet or outlet port for said fluid external to said enclosure, wherein in use of the apparatus fluid flows substantially transversely from said inlet duct to said outlet duct through said solid material in said passage, and wherein each said fluid duct has a second opening in at least one of said enclosure end walls for fluid communication between said internal space of said fluid duct and said inlet or outlet port of said fluid duct.

In this aspect, the invention can allow for construction of an apparatus with many said passages, using modules each having a single passage.

In a further aspect, the invention provides a method for passing a fluid through a solid material including the steps of providing apparatus in any of the forms disclosed above, passing said solid material through said passages of said apparatus, and passing said fluid into inlet fluid ducts and out of said outlet fluid ducts of said apparatus.

Further aspects and features of the invention will be disclosed below including in the appended claims.

DETAILED DESCRIPTION OF PREFERRED EMBODIMENTS OF THE INVENTION

In the Figures the wavy arrows indicate the direction of flow of a fluid and the solid arrows indicate the direction of travel of a solid material.

The invention in this embodiment is applicable to many applications, such as the applications mentioned earlier herein, and it will therefore be described in general terms as an apparatus for passing a fluid through a solid material.

Figure 1:
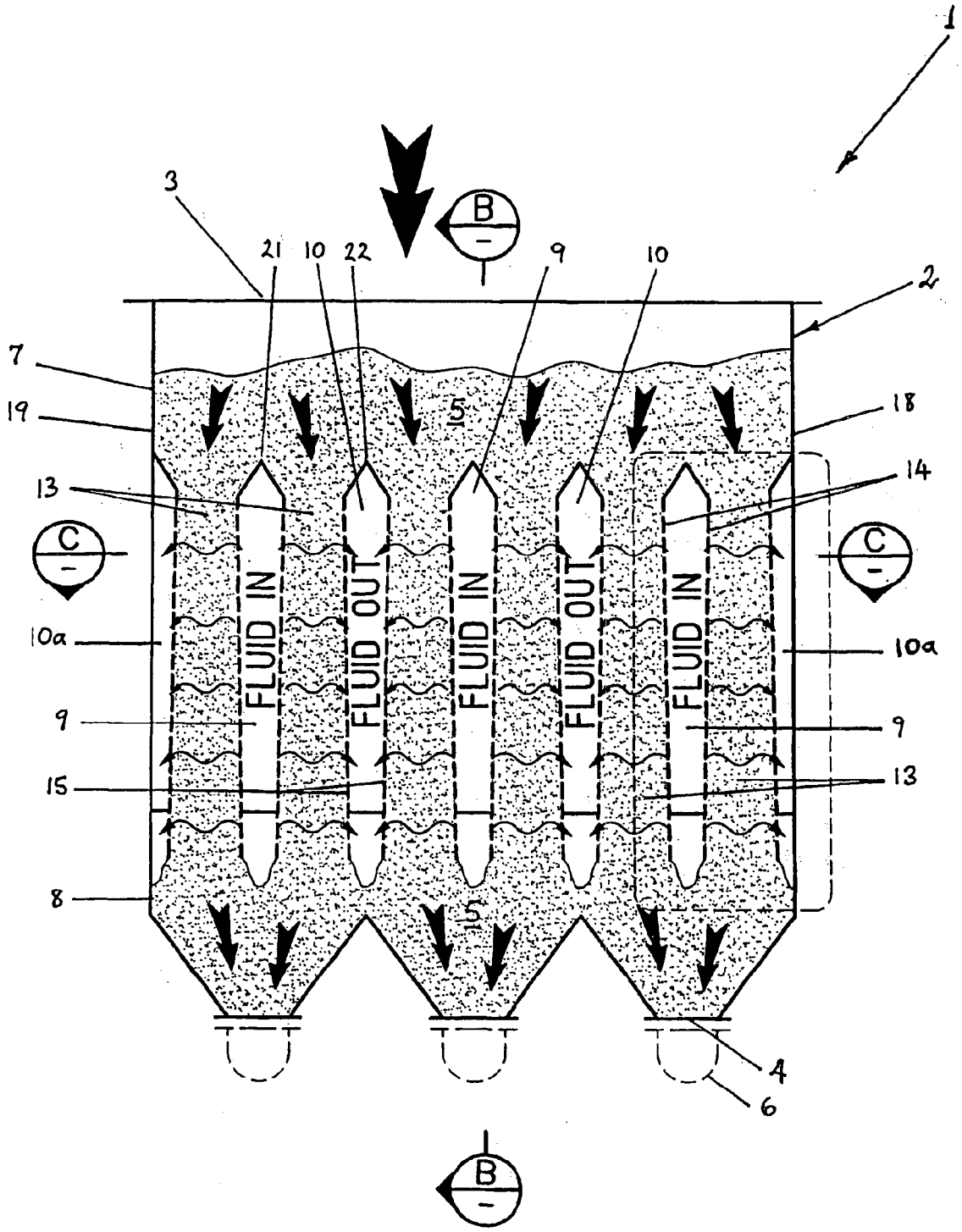
FIG. 1 is a first sectional view (on a vertical plane) of an apparatus according to the invention.
Figure 2:
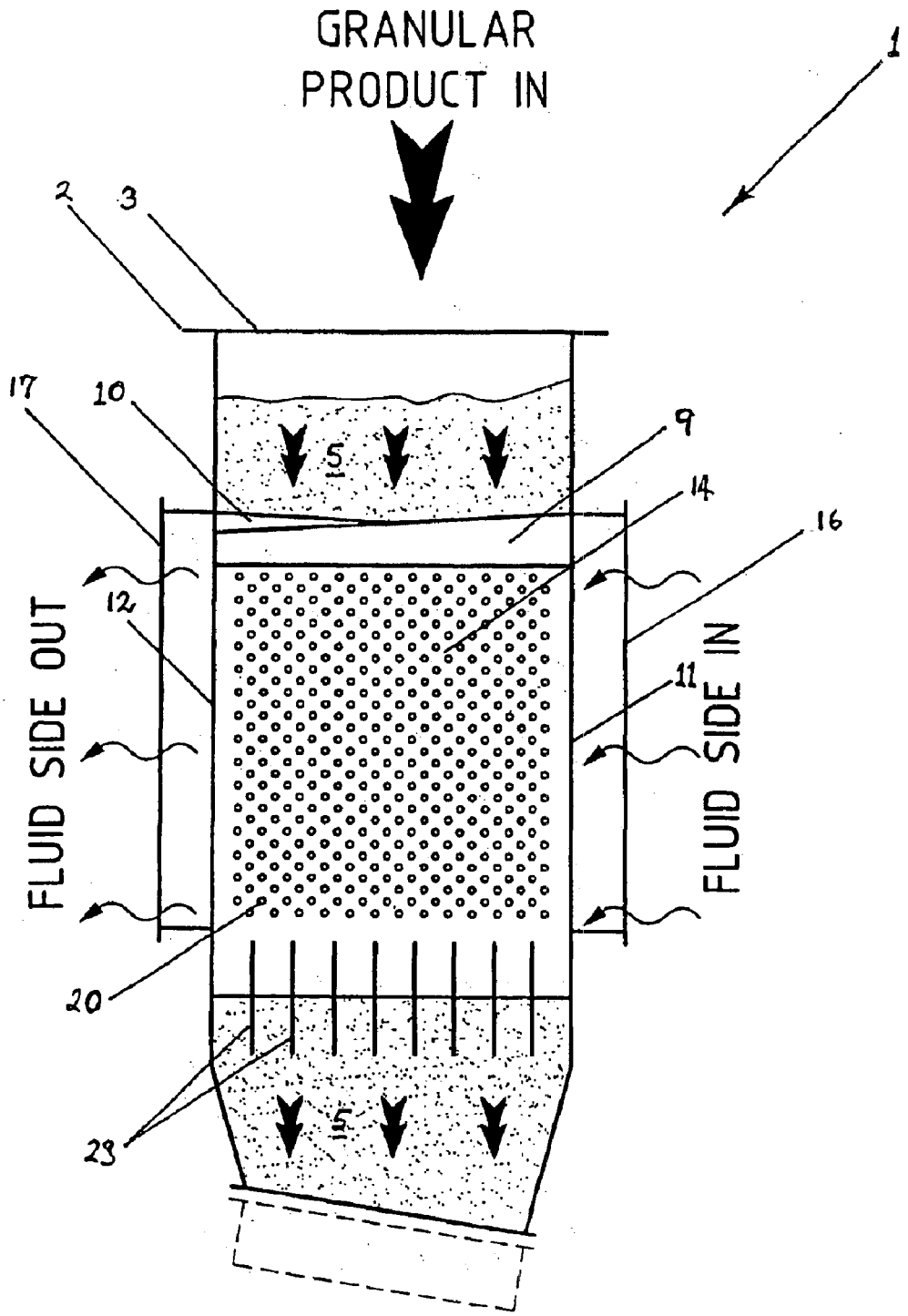
FIG. 2 is a second sectional view of the apparatus shown in FIG. 1, taken along the line BB'.
Figure 3:
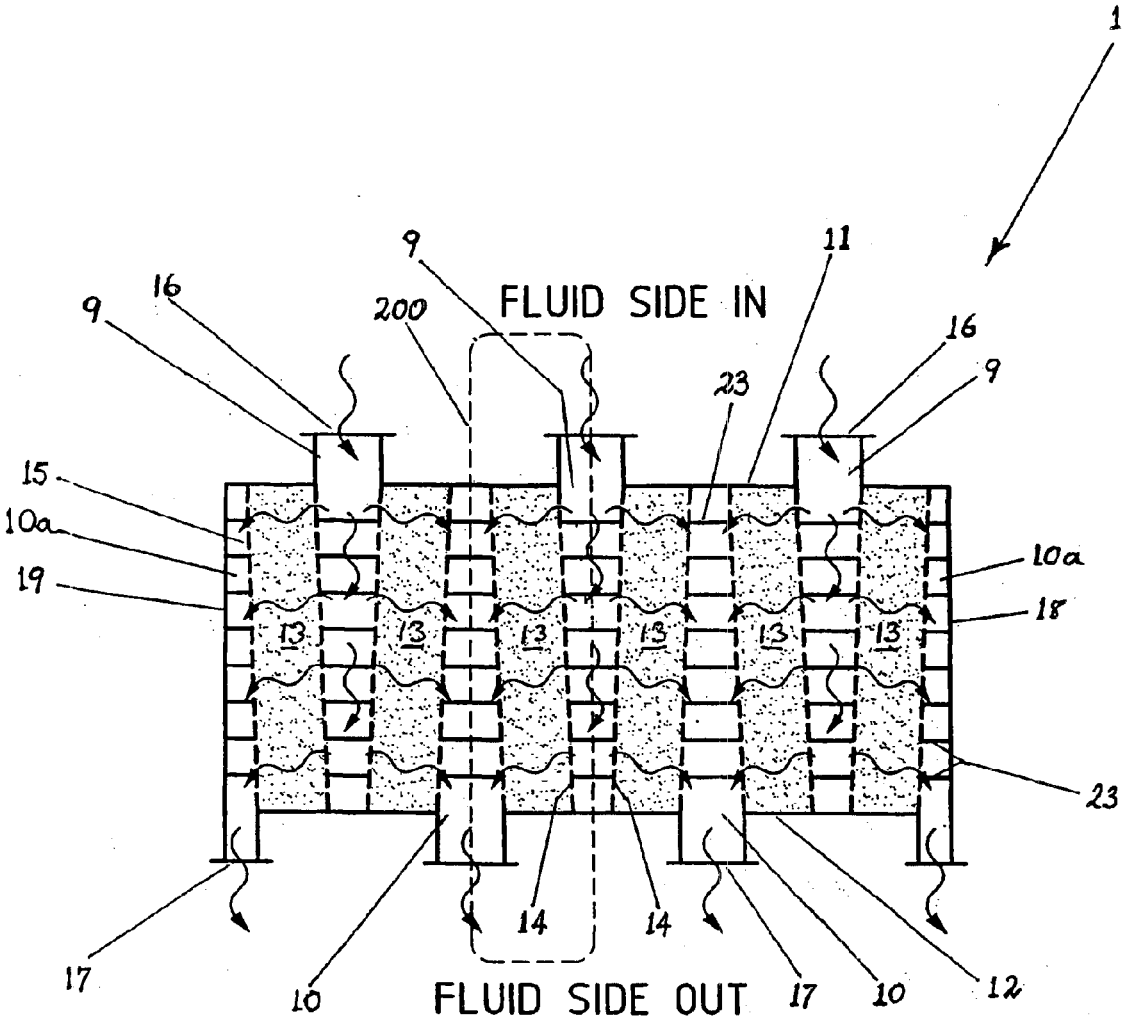
FIG. 3 is a third sectional view of the apparatus shown in FIG. 1, taken along the line CC' indicated in FIG. 1.

Turning firstly to FIG. 1, an apparatus 1 according to the invention comprises an enclosure 2 having an inlet 3 and one or more outlets 4 for the solid material 5 to be treated. Each outlet 4 preferably has an outlet regulator 6, such as for example a variable speed screw conveyor, which can be used to control the passage of the solid material 5 through the apparatus. Similar means (not shown) may be provided to control the amount of solid material 5 fed into the drier 1 through inlet 3. The embodiment shown in FIGS. 1 to 3 is based on a vertical configuration in which the solid material 5 passes through the apparatus 1 under the force of gravity.

The enclosure 2 has an upper part 7 which receives the solid material 5, and a lower part 8 into which the solid material 5 passes. Between the upper part 7 and the lower part 8 the enclosure includes fluid inlet ducts 9 and fluid outlet ducts 10. Ducts 9 and 10 extend between end walls 11 and 12 of enclosure 2. Between the ducts 9 and 10 are passages 13 which in use of the apparatus 1 allow the solid material 5 to flow from upper part 7 to lower part 8 of enclosure 2.

Each fluid inlet duct 9 and fluid outlet duct 10 has either one or two perforated side plates 14 or 15. Fluid may be introduced into the fluid inlet ducts 9 through inlet ports 16 and removed from the fluid outlet ducts 10 via outlet ports 17. Fluid inlet ducts 9 have closed ends at end wall 12 and fluid outlet ducts 10 have closed ends at end wall 11. In use of the apparatus 1, the fluid percolates substantially transversely from fluid inlet ducts 9 and through the solid material in passages 13, a substantial proportion leaving the apparatus 1 via the outlet fluid ducts 10. Each passage 13 has a fluid inlet duct 9 on one side and a fluid outlet duct 10 on the other side.

Pump(s), fan(s) or blower(s) (not shown) may be provided to pump the fluid into the fluid inlet ducts 9 and/or to draw it from the fluid outlet ducts 10.

As best seen in FIG. 3, each of the ducts 9 and 10 is tapered in width between the end walls 11 and 12. This measure is advantageous in providing a more even distribution of flow across the gap between the end walls 11 and 12.

It will be noted in FIGS. 1 to 3 that those fluid outlet ducts 10*a* adjacent to sidewalls 18 and 19 of enclosure 2 have perforated plates 15 on one side only and are of smaller cross-sectional area. This achieves the objective of ensuring that all passages 13 have fluid flowing transversely therethrough. It is of course possible to configure the apparatus 1 in such a way that such ducts are fluid inlet ducts or in such a way that one is a fluid inlet duct and one is a fluid outlet duct.

It would be possible to provide inlet or outlet ports for fluid outlet ducts 10*a* on the sidewalls 18 and 19 of enclosure 2. However, where all ports of the fluid inlet and outlet ducts 9, 10 and 10*a* are on endwalls 11 and 12, the arrangement is more compact, generally easier to connect to external systems and may permit better matching of flow rates in the several ducts 9, 10 and 10*a*. The arrangement also lends itself to the placement of several modules of apparatus 1 side-by-side in modular fashion.

As best seen in FIG. 3, passages 13 are of constant width across the gap between end walls 11 and 12. This gives the most even exposure of solid material 5 to the flow of fluid. Having the ports 16 and 17 on different end walls 11 and 12 conveniently allows constant-width passages 13 and tapering of the widths of fluid inlet and outlet ducts 9 and 10 and is a particularly favoured configuration.

As best seen in FIG. 1, passages 13 increase in width downwards, to minimize friction and any tendency to blockage. The degree of taper appropriate for any particular application (whether drying or otherwise) may be chosen by straightforward trialling.

The perforated plates 14 and 15 may be substantially flat (planar) as shown, or may be corrugated, or curved in either the vertical or horizontal direction, subject always to the need to ensure free flowing of the solid material 5. The perforations 20 may be simple holes, but there are other possibilities which will suggest themselves to persons skilled in the art, such as louvres similar to those mentioned in U.S. Pat. No. 4,349,367.

Figure 3A:
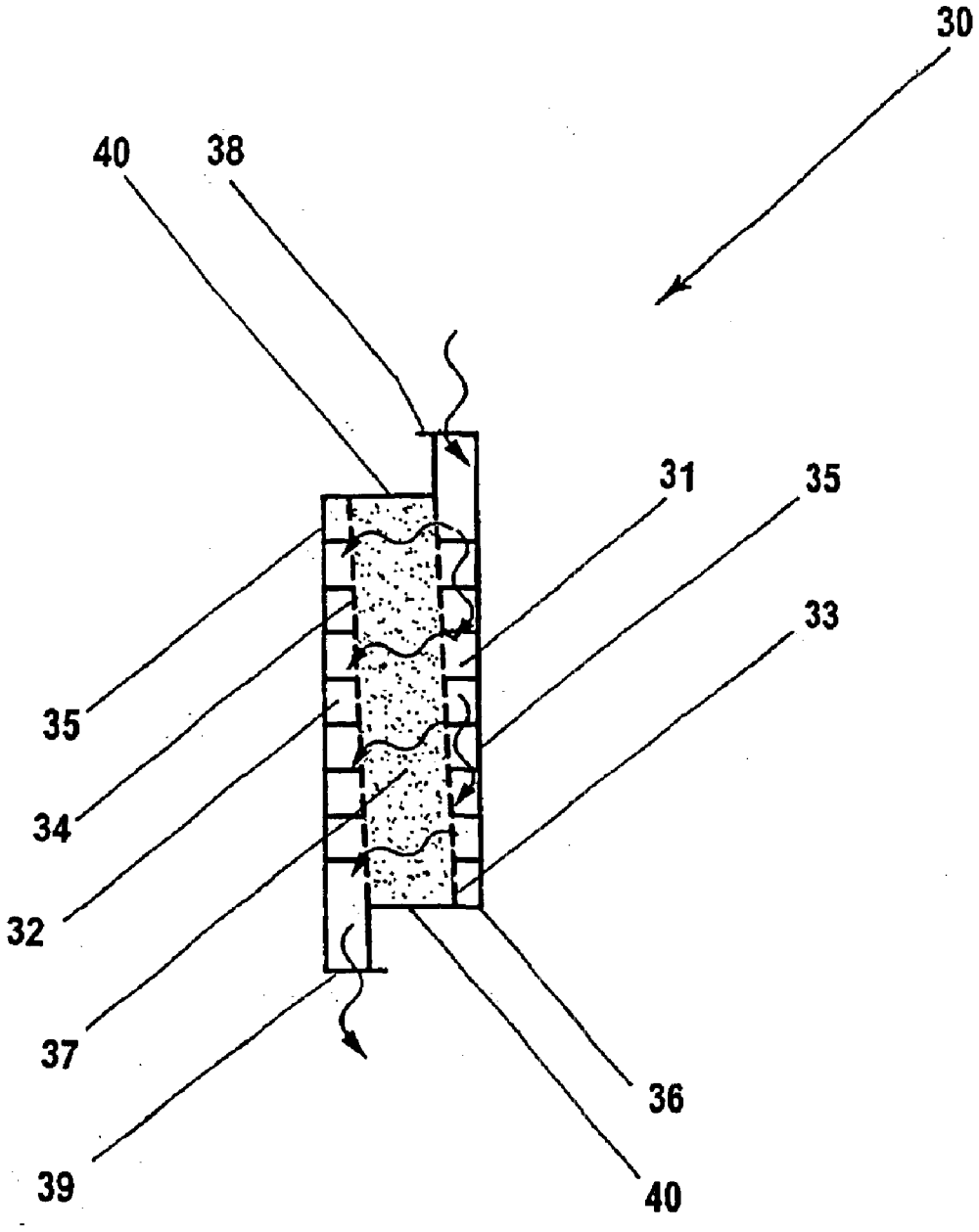
FIG. 3A is a sectional view from a viewpoint similar to that of FIG. 3 of a further embodiment of the invention.

FIG. 3A shows, in a view equivalent to that of FIG. 3, an apparatus 30 having a single fluid inlet duct 31 and a single fluid outlet duct 32, on either side of a single solid material flow passage 37. In this embodiment the fluid inlet and fluid outlet ducts 31 and 32 include only single perforated plates 33 & 34, respectively, with side walls 35 of enclosure 36 providing the opposite wall for each duct. This embodiment also offers the possibility of making an apparatus with multiple passages, corresponding to the passages 13 shown in the apparatus 1, from modules such as the apparatus 30. This is facilitated by having inlet and outlet ports 38 and 39 on endwalls 40. The part of apparatus 1 within dotted boundary 200 in FIG. 3 would then correspond to one module such as apparatus 30.

The apparatus of the invention provides effective treatment by the fluid of the solid material (or vice versa) by providing a high cross-sectional area of fluid flow through a body of solid material in a small enclosure 2 (or 36) of simple construction.

In some applications, such as drying of coal, the solid material may be prone to forming dust through attrition of the moving granules. The apparatus of the invention is preferably designed to have as few horizontal flat surfaces as possible in order to reduce internal dust buildup and to avoid impeding the passage of the solid material. For example the fluid inlet ducts 9 and fluid outlet ducts 10 are preferably formed with an apex (21 and 22 respectively) at their leading edges. Additionally, ducts 9 and 10 (or one of these groups) may be provided (as shown in FIG. 1) without a bottom plate such that any particulates which may pass through the perforated plates 14 and 15 can simply be deposited on the solid material 5 below, thus being carried away with it. To assist in this deposition, the bottom regions of the fluid inlet and fluid outlet units are preferably designed to produce low local fluid velocities; for example anti-dust baffles 23 may be provided at the trailing edges of the fluid inlet and fluid outlet ducts 9 and 10. Disposition of such baffles 23 across the primary direction of fluid flow reduces the likelihood of dust (or other small) particles being swept up by the fluid. Particulate scrubbers, (such as for example water scrubbers in a dust-removal-from-gas application) may be provided on the fluid outlet side of the apparatus in order to ensure that transfer of dust or particulates from the solid material to the fluid and on to subsequent components in the system (or ultimately the environment) is minimized.

material is passing through the apparatus, causing the fluid to be passed through the inlet and outlet fluid ducts 9 and 10 (or 31 and 32) of the apparatus.

While the apparatus of the invention potentially has many applications, an example for which it is believed to be particularly suited is the drying of brown coal. The following description exemplifies the use of the apparatus and method of the invention in a process for drying brown coal in a system which utilizes waste heat from an associated brown coal burning power station.

An example of the application of the apparatus and method of the present invention is its use as a drier in the drying of pelletised brown coal (solid material) using warm air as the drying agent (gas). In this example preferably the energy source (for producing warm air) is derived from waste heat available for example from a mine's hot artesian water or from cooling water normally used in an associated power station. Relatively wet as-mined brown coal (such as brown coal mined in the La Trobe Valley, Victoria, Australia, which typically has a moisture content of 65% by weight) can be partially dried (resulting in say a 5% reduction in moisture content to 60%) by taking a side-stream of mined material from the main coal feeder to the power station, pelletising or granulating the material, passing the granulate through a drier according to the invention and then returning the partially dried side-stream of brown coal to the main feeder. The overall effect is a reduction in the overall moisture content of the brown coal feeding the power station and subsequent energy saving in the operation of the power station itself (for example, since the moisture content of the fuel is reduced prior to combustion, the volume of combustion gases produced in the boiler is lower requiring less fan-power to pump those gases through the boiler circuit).

Figure 4:
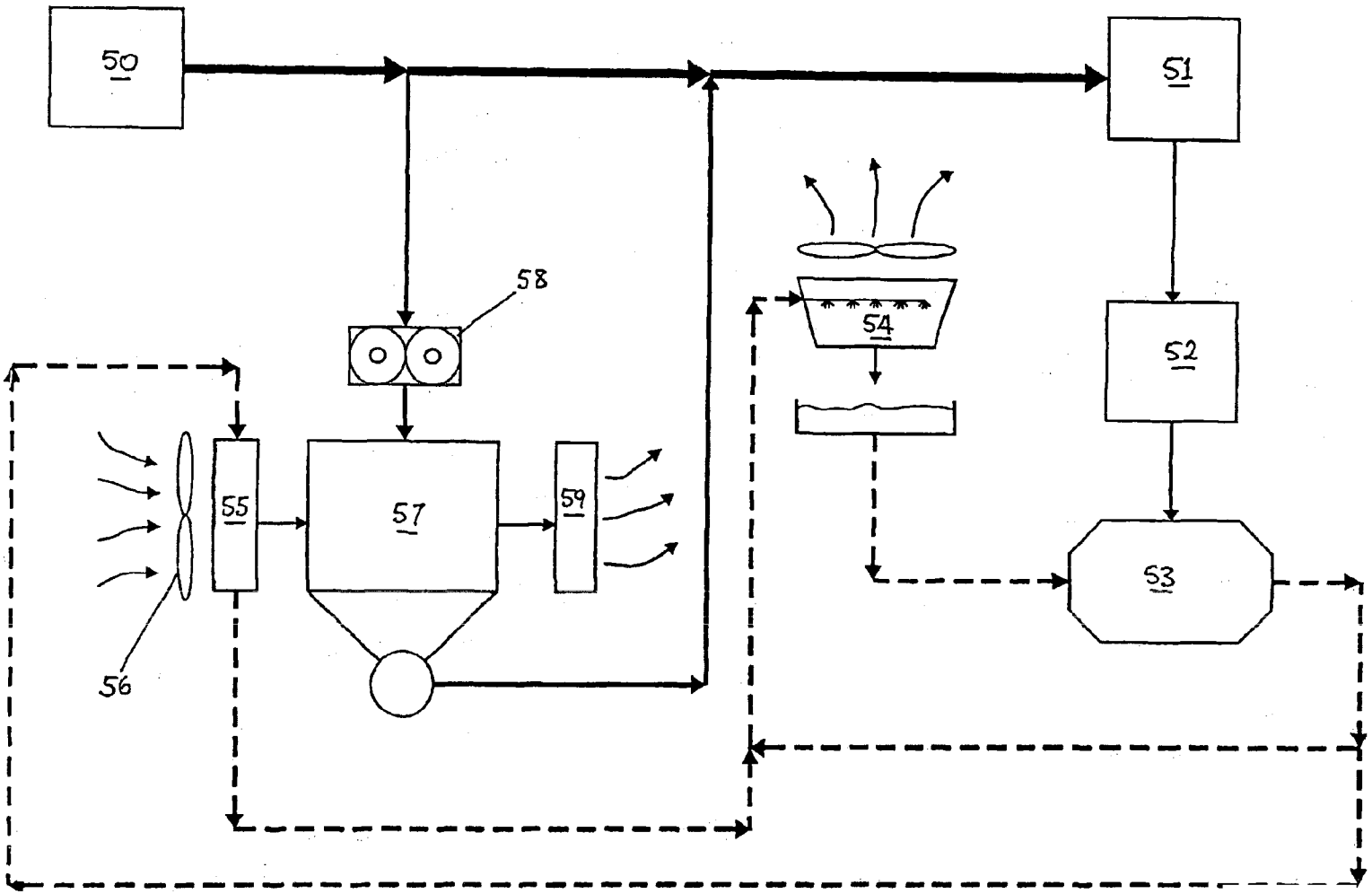
FIG. 4 is a schematic diagram of a system for drying brown coal using the present invention.

FIG. 4 shows a possible circuit for such an application, and will be described only briefly, being readily understandable by persons skilled in the art. The circuit shows that brown coal from a mine 50 is conveyed to a boiler installation 51 whereby steam is produced to drive turbines 52 and thereafter is condensed by condenser(s) 53. Some cooling water from the condensers 53, instead of passing directly to cooling tower(s) 54, is diverted to a heat exchanger 55 to heat air driven by a fan 56 into a drier 57 being an apparatus according to the invention, such as apparatus 1. The drier 57 receives (as its solid material) coal pelletized in a pelletizer 58, the coal being a part of the total coal feed diverted through the pelletizer 58. Dried coal is returned to the input stream, while if necessary air emerging from the drier 57 passes through a suitable scrubber 59. Water from heat exchanger 55 finally returns to the stream passing to the cooling tower(s) 54.

The overall heat load to the cooling towers is reduced by the quantity of energy transferred to the air. As a consequence the cooling water returning to the turbine condenser (s) 53 is cooler and the vacuum in the condenser steam space is improved, thus increasing the output of the turbines 52 for the same fuel consumption. Whilst this increase in output may not be large, it would mitigate the power usage in the drying process. Additionally, given that the coal being used in the power station contains less water, the transport, processing and handling power usage will also be reduced.

In addition, the water evaporated from the coal does not have to be evaporated from the cooling water circuit and therefore the make-up water to the cooling water is reduced by the amount evaporated from the cooling water. For those situations where it is practicable and economic to dry the coal to a much lower moisture content, such that a much larger quantity of water is evaporated by the dryer, the amount of water that needs to be evaporated by the cooling towers may be so reduced that significant equipment and water consumption savings could be realized in retrofitting existing plant as well as in new, purpose designed, plant. Indeed, whereas normally low moisture fuels would need the full component of the cooling water evaporation, the high moisture from coal would substitute, at least in part the make-up water requirement from the normally valuable sources (rivers etc.)

Many variations may be made to the invention as described without departing from the spirit or scope of the invention. The following claims form a further part of the disclosure of the invention.

What is claimed is:

1. Apparatus for passing a fluid through a solid material including:

an enclosure having an upper part adapted for the receipt of a solid material and a lower part adapted to receive said solid material from said upper part; and a plurality of passages extending between a pair of end walls of said enclosure and connecting said upper and lower parts, wherein sides of said passages are defined by side walls of a plurality of inlet fluid ducts and outlet fluid ducts extending between said end walls, said side walls having first openings into said passages whereby internal spaces of said ducts are in fluid communication with said passages, wherein each said inlet or outlet duct has respectively an inlet or outlet port for said fluid external to said enclosure, wherein each said passage has on its opposing sides an inlet fluid duct and an outlet fluid duct so that in use of the apparatus fluid flows substantially transversely from an inlet duct to an outlet duct through said solid material in each said passage, and wherein the or each said fluid duct that lies between adjacent said passages has a second opening in at least one of said enclosure end walls for fluid communication between said internal space of said fluid duct and said inlet or outlet port of said fluid duct.

2. Apparatus according to claim 1 wherein at least one of said inlet or outlet fluid ducts decreases in width with increasing distance from the or a said port thereof.

3. Apparatus according to claim 1 wherein at least one of said fluid ducts has a closed end remote from its said port and at or adjacent to the said end wall remote from its said port.

4. Apparatus according to claim 1 wherein each said passage increases in width from top to bottom thereof.

5. Apparatus according to claim 1 wherein each said passage is of substantially constant width between said enclosure end walls.

6. Apparatus according to claim 1 further including means for controlling egress of said solid material from said lower part of said enclosure.

7. Apparatus according to claim 1 wherein the or each said fluid duct is shaped on an upper part thereof for free flow of said solid material into said passages and without lodgement on said upper part of any of said solid material.

8. Apparatus according to claim 1 wherein the or each said fluid duct is open bottomed, whereby any of said solid material entering said duct can fall into said lower part of said enclosure.

9. Apparatus according to claim 8 having within the or each said fluid duct at least one baffle plate extending transversely across a lower part of said duct.

10. A method for passing a fluid through a solid material including the steps of providing apparatus according to claim 1, passing said solid material through said passages of said apparatus, and passing said fluid into inlet fluid ducts and out of said outlet fluid ducts of said apparatus.

11. Apparatus for passing a fluid through a solid material including:

an enclosure having an upper part adapted for the receipt of a solid material and a lower part adapted to receive said granular material from said upper part; and a passage extending between a pair of end walls of said enclosure and connecting said upper and lower parts, wherein opposing sides of said passage are defined by side walls of an inlet fluid duct and an outlet fluid duct extending between said end walls, said side walls having first openings into said passage whereby internal spaces of said ducts are in fluid communication with said passage, wherein said inlet and outlet ducts have respectively an inlet or outlet port for said fluid external to said enclosure, wherein in use of the apparatus fluid flows substantially transversely from said inlet duct to said outlet duct through said solid material in said passage, and wherein each said fluid duct has a second opening in at least one of said enclosure end walls for fluid communication between said internal space of said fluid duct and said inlet or outlet port of said fluid duct.

* * * * *